US006024261A

United States Patent [19]

Tseng

[11] Patent Number: 6,024,261

[45] Date of Patent: Feb. 15, 2000

[54] MODEL HAVING A FOLDABLE LIMB

[76] Inventor: Wen Hui Tseng, No. 162, Sec. 2, Chang Pin Road, Taichung, 406, Taiwan

[21] Appl. No.: 09/115,337

[22] Filed: Jul. 14, 1998

[51] Int. Cl.[7] ..... D06C 15/00; F16C 11/00

[52] U.S. Cl. ..... 223/66; 223/71; 403/128; 403/122

[58] Field of Search ..... 223/66, 71; 403/128, 403/122, 114

[56] References Cited

U.S. PATENT DOCUMENTS

| | | | |
|---|---|---|---|
| 2,289,154 | 7/1942 | Van Cise | 403/128 |
| 3,411,737 | 11/1968 | Zieber | 403/128 |
| 4,603,762 | 8/1986 | Stringer | 223/66 |
| 5,180,086 | 1/1993 | Ikeda | 223/66 |
| 5,807,010 | 9/1998 | Parker et al. | 403/122 |

*Primary Examiner*—Bibhu Mohanty

[57] ABSTRACT

A foldable limb for a model includes two or more segments pivotally coupled together for forming the foldable limb and for allowing people to easily dress the model. One of the segments includes a ball and a pivot shaft engaged through the ball. The other segment includes a coupler having a socket rotatably engaged with the ball and a post extended from the socket for slidably receiving a hook. The hook is hooked to the pivot shaft and a spring may bias the hook to resiliently engage with the pivot shaft.

5 Claims, 3 Drawing Sheets

MODEL HAVING A FOLDABLE LIMB

BACKGROUND OF THE INVENTION

1. Field of the Invention

The present invention relates to a model, and more particularly to a model having a foldable limb.

2. Description of the Prior Art

Typical nude models are made of wax materials or plastic materials or other artificial materials and include a pair of arms and a pair of legs that include a solid structure such that the arms and the legs may not be easily folded and such that people may not easily dress the model.

The present invention has arisen to mitigate and/or obviate the afore-described disadvantages of the conventional models.

SUMMARY OF THE INVENTION

The primary objective of the present invention is to provide a model having a foldable arm and/or a foldable leg for allowing people to easily dress the model.

In accordance with one aspect of the invention, there is provided a foldable limb for a model, the foldable limb comprising a first segment including a first end having a ball and having a slit formed in the ball, a pivot shaft secured to the ball and extended through the slit of the ball, a second segment, a coupler secured to the second segment and including a socket rotatably engaged with the ball and including a post extended from the socket, the post including a bore, a hook slidably received in the bore and including a hook member engaged into the slit and hooked with the pivot shaft, and means for biasing the hook member to engage with the pivot shaft.

The hook member is formed on a first end of the hook which includes a second end. The hook member biasing means is engaged between the second end of the hook and the post for biasing the hook member to engage with the pivot shaft. The post includes a cavity, the hook member biasing means includes a plurality of resilient washers engaged on the hook.

A beam is further secured in the second segment, the beam includes a puncture formed therein for receiving the post of the coupler. The beam includes a spring-biased catch device for engaging with the post and for securing the post to the beam.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
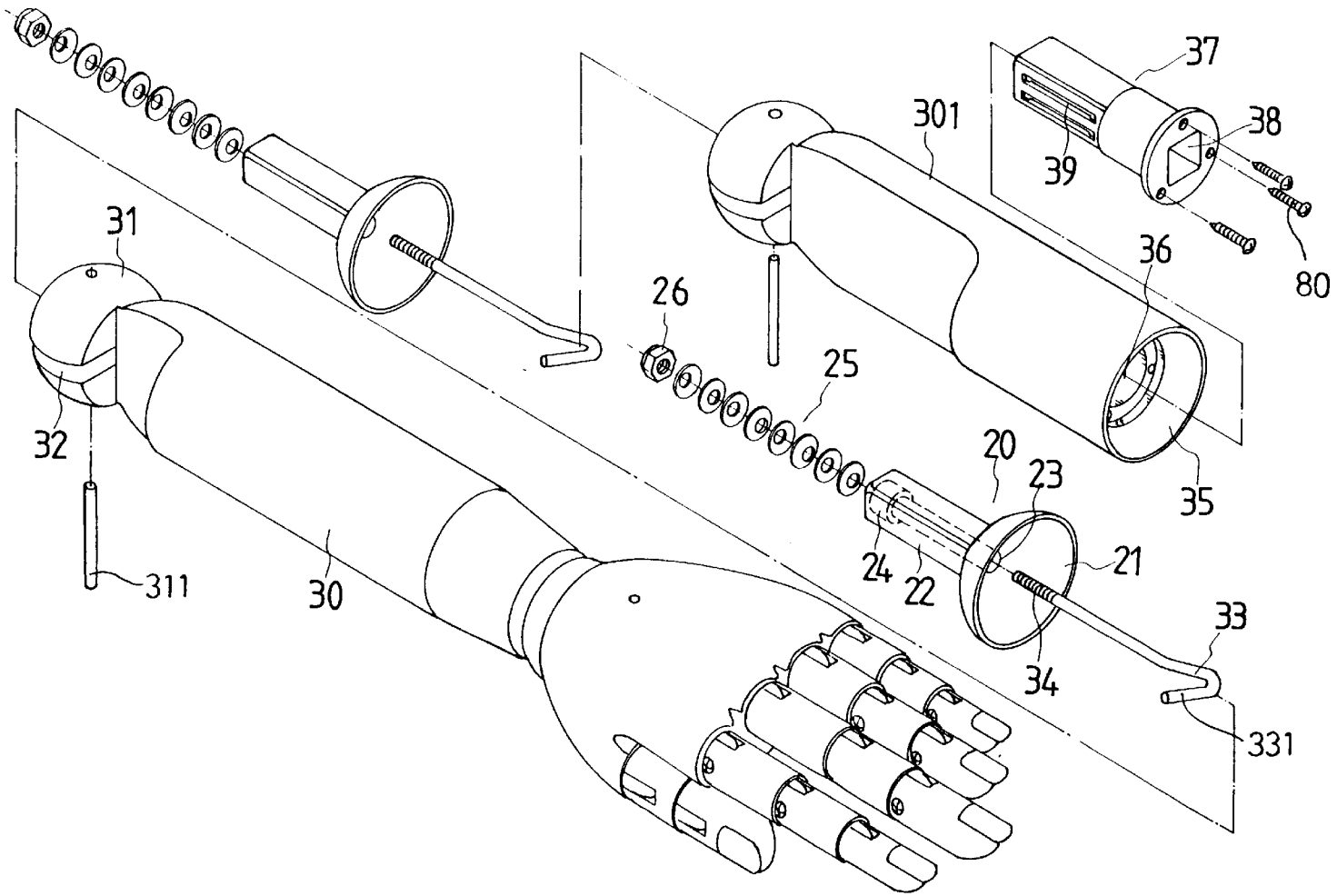
FIG. 1 is an exploded view of a foldable limb for a model in accordance with the present invention.
Figure 2:
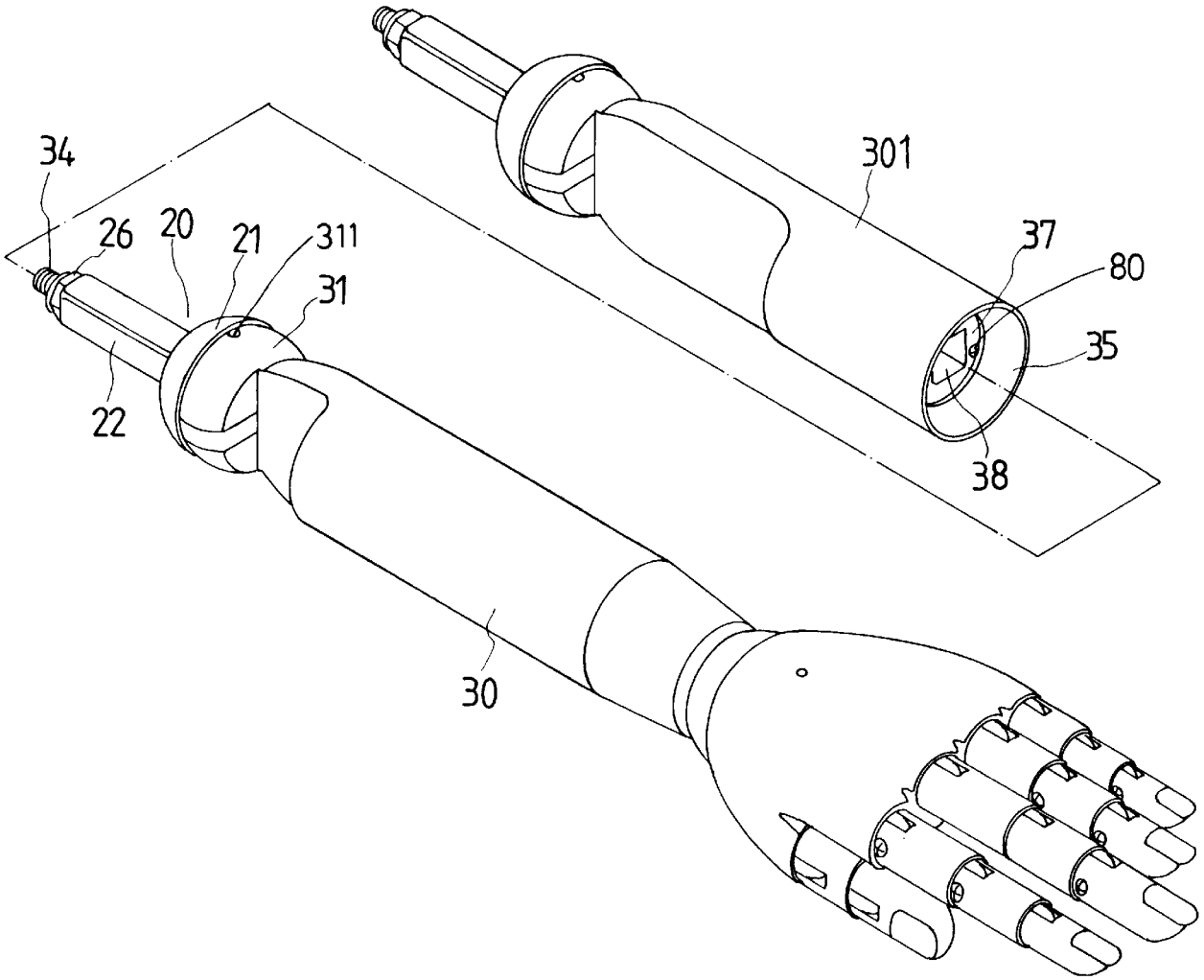
FIG. 2 is a partial exploded view of the limb.
Figure 3:
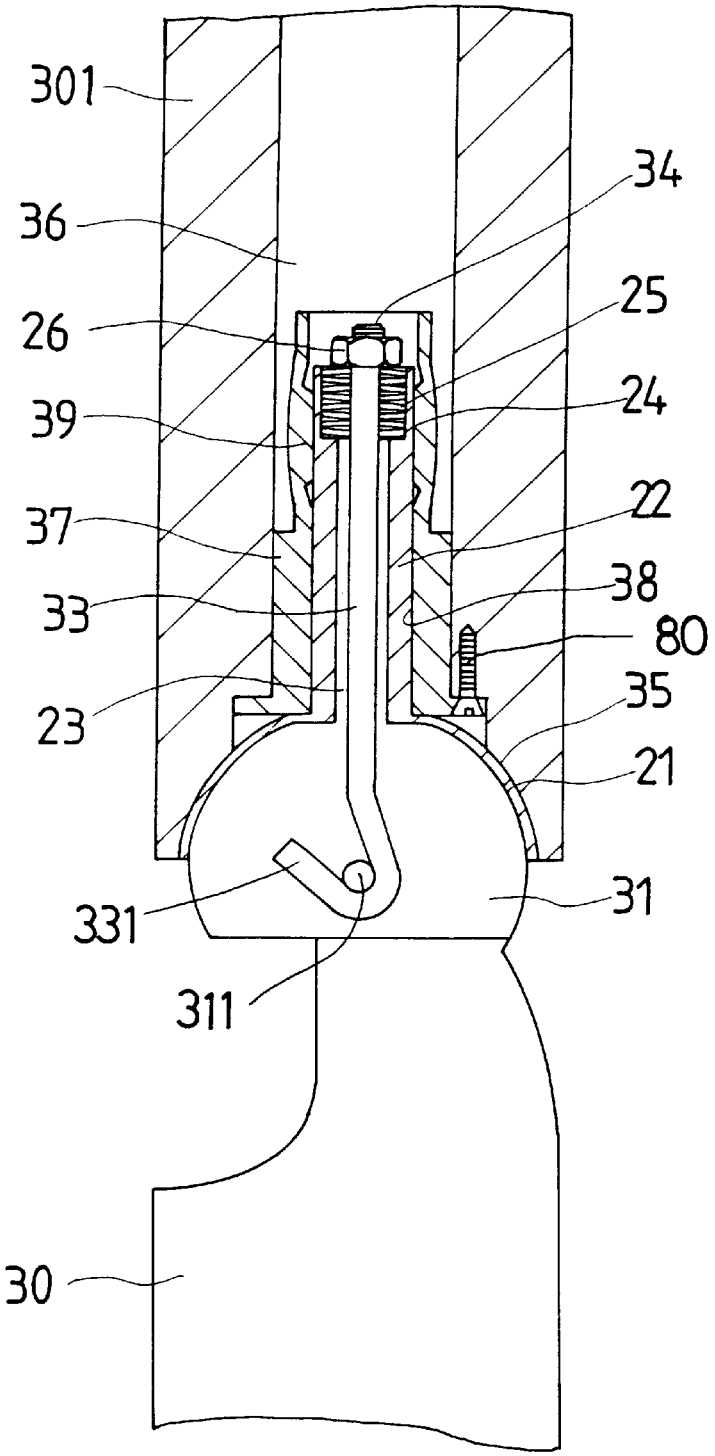
FIG. 3 is a partial cross sectional view of the foldable limb.

Referring to the drawings, and initially to FIGS. 1 and 2, a foldable limb in accordance with the present invention may be used as a foldable arm or a foldable leg for a nude model and comprises two or more segments 30, 301 to be pivotally secured together. The segments 30, 301 each includes a ball 31 formed on one end and a slit 32 formed in the ball 31. A pivot shaft 311 is secured in the ball 31 and engaged through the slit 32. A coupler 20 includes a socket 21 rotatably engaged with the ball 31 and a post 22 extended from the socket 21. The post 22 includes a bore 23 for slidably receiving a hook 33 which includes an outer thread 34 formed on one end for engaging with a nut 26 and which includes a hook member 331 formed on the other end. The post 22 includes a cavity 24 formed in one end and communicating with the bore 23 for receiving a spring member formed by a number of spring washers. The hook member 331 of the hook 33 may engage into the slit 32 of the ball 31 and may hook with the pivot shaft 311 such that the segments 30, 301 may be rotated relative to each other about the pivot shaft 311. The spring member 25 may bias the hook 33 to resiliently force the socket 21 to the ball 31 (FIG. 3).

The segment 301 includes a hole 36 and a recess 35 communicating with the hole 36. The recess 35 includes a curved inner peripheral surface for engaging with the socket 21 which is preferably semi-spherical. A beam 37 is engaged into the hole 36 and secured to the segment 301 by such as a force-fitted engagement or by fasteners 80. The beam 37 includes a puncture 38 formed therein for receiving the post 22 of the coupler 20, and includes one or more spring-biased catches 39 for engaging with the post 22 and for securing the coupler 20 to the beam 37 and thus to the segment 301. Without the catches 39, the coupler 20 may also be secured to the beam 37 by such as force-fitted engagements. The ball 31 and the coupler 20 thus form a pivotal coupling device for pivotally coupling the segments 30, 301 together. The segments 30, 301 may be used as the leg or the arm of the model.

Accordingly, the model in accordance with the present invention includes a foldable arm and/or a foldable leg for allowing people to easily dress the model.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A foldable limb for a model, said foldable limb comprising:

a first segment including a first end having a ball and having a slit formed in said ball, a pivot shaft secured to said ball and extended through said slit of said ball, a second segment, a coupler secured to said second segment and including a socket rotatably engaged with said ball and including a post extended from said socket, said post including a bore, a hook slidably received in said bore and including a hook member engaged into said slit and hooked with said pivot shaft, and means for biasing said hook member to engage with said pivot shaft.

2. The foldable limb according to claim 1, wherein said hook includes a first end having said hook member formed thereon and includes a second end, said hook member biasing means is engaged between said second end of said hook and said post for biasing said hook member to engage with said pivot shaft.

3. The foldable limb according to claim 2, wherein said post includes a cavity, said hook member biasing means includes a plurality of resilient washers engaged on said hook.

4. The foldable limb according to claim 1 further comprising a beam secured in said second segment, said beam including a puncture formed therein for receiving said post of said coupler.

5. The foldable limb according to claim 4, wherein said beam includes a spring-biased catch device for engaging with said post and for securing said post to said beam.

* * * * *